United States Patent [19]

Crepeau

[11] Patent Number: 4,464,870

[45] Date of Patent: Aug. 14, 1984

[54] STAIRWAY-BUILDING SYSTEM

[76] Inventor: Richard E. Crepeau, 2045 Canal Dr., Redding, Calif. 96001

[21] Appl. No.: 436,448

[22] Filed: Oct. 25, 1982

[51] Int. Cl.[3] ..... EO4F 11/00

[52] U.S. Cl. ..... 52/188; 52/191

[58] Field of Search ..... 52/741, 182, 188, 191; 182/1

[56] References Cited

U.S. PATENT DOCUMENTS

| | | | |
|---|---|---|---|
| 2,021,457 | 11/1935 | MacKenzie | 52/191 |
| 2,696,027 | 12/1954 | Ryland | 52/182 |
| 3,564,793 | 2/1971 | Willfurth | 52/182 |
| 3,909,997 | 10/1975 | Eickhof | 52/188 |
| 4,154,032 | 5/1979 | Strub | 52/188 |

FOREIGN PATENT DOCUMENTS

| | | | |
|---|---|---|---|
| 176664 | 11/1953 | Austria | 52/182 |
| 427127 | 11/1947 | Italy | 52/182 |
| 13626 | of 1900 | United Kingdom | 52/182 |

*Primary Examiner*—Carl D. Friedman

*Attorney, Agent, or Firm*—Leonard D. Schappert

[57] ABSTRACT

A stairway construction system is provided utilizing modular tread/riser stair step units and two or more notchless stringers.

7 Claims, 3 Drawing Figures

STAIRWAY-BUILDING SYSTEM

BACKGROUND OF THE INVENTION

1. Field of the Invention

The present invention relates generally to construction of stairways, and is directed more particularly to the use of prefabricated treadriser stair step units in combination with unnotched stringers.

2. Description of the Prior Art

In the past, stairways have generally been constructed using two or more parallel notched stringers extending between an upper floor and a lower floor of a building, with tread and riser members attached to and extending between corresponding notches of the stringers to form stair steps. The notches in each stringer are cut at right angles to facilitate the attachment of tread and riser members. As a result of the notching of the stringers, the physical strength of a given piece of lumber used for a stringer is reduced considerably. Consequently, the lumber used to make notched stringers must be considerably larger than would be required if the stringers were unnotched. This has resulted in increased cost of stairway construction over what would be encountered if solid stringers could be used. Furthermore, because of the varying floor space available for given stairways and the varying vertical distance between the lower and upper levels of buildings, notched stringers could not be mass-produced but had to be custom-made and, as a result, continued to be expensive. Thus the cost of building a stairway has remained inordinately high. Further practical problems have been encountered in some cases because of inaccurate calculations resulting in a bottom riser of a different vertical dimension than that of the remaining risers, and in other cases because of inaccurate notching of one stringer in a pair. If the notches on a given pair of stringers are not precisely matched, the tread and riser members align improperly, which results in a weakening of the stairway system and a shoddy-looking appearance. More recently, tread and riser members have been cut and prefabricated to fit upon unnotched stringers. However, such prefabricated stair step units have required toe cleats or other relatively expensive structural support in order to achieve the desired strength and proper attachment to the stringer. This has resulted in a stairway which is generally as expensive as, and sometimes more expensive than, the conventional stairway built with notched stringers. Applicant is unaware of any prior art which teaches the unique construction of the present invention.

SUMMARY OF THE INVENTION

The present invention consists of a stairway system which utilizes unnotched stringers in conjunction with prefabricated stair step units which do not require toe cleats in order to ensure strength and safety. The prefabricated step unit consists of a tread member with a groove in its bottom surface and a riser member rigidly attached at the groove to the tread member. A structural support block is attached to the tread and riser to give the stair step unit structural integrity.

One of the objects of the present invention is to provide a stairway system which is safe, quickly assembled and inexpensive to build.

Another object of the present invention is to provide an unique prefabricated tread-riser component which easily attaches to unnotched stringers without requiring the use of toe cleats to increase the strength of the stairway.

Another object of the present invention is to provide a stairway construction system which is easily built by nonprofessionals and which, because of its physical structure, can be assembled very quickly.

The foregoing objects and other further objects will become more apparent in the following description of the drawings, description of the preferred embodiment and claims.

DESCRIPTION OF THE PREFERRED EMBODIMENT

Figure 1:
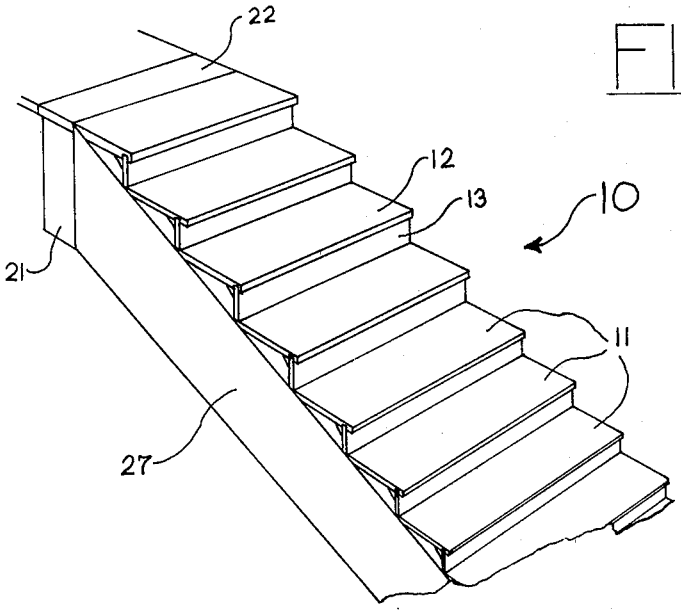
FIG. 1 is a perspective view of a complete stairway system built in accordance with the present invention.

FIG. 1 shows a complete stairway (10) and the individual component pieces used therein. Stairway (10) consists of an unnotched stringer (27) and one or more additional unnotched stringers parallel thereto and extending between an upper and lower floor of a building. Step units (11) are mounted on stringers (27) and form contiguous stair steps.

Figure 2:
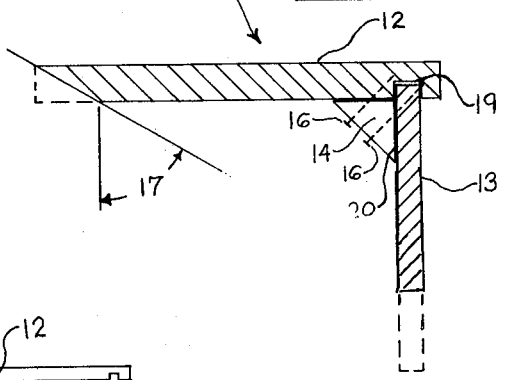
FIG. 2 is a side view showing the physical construction of the tread-riser module.

FIG. 2 is a side view of the step unit (11) showing its construction. Step unit (11) consists of a tread (12) and riser (13) assembled at right angles to each other, with structural support means consisting of structural support block (14) added to give step unit (11) strength. In the construction of step unit (11), tread (12) is slotted longitudinally as shown at (19), and riser (13) is inserted into slot (19) and glued in place. Structural support block (14) is secured to tread (12) and riser (13) with glue (20) and fasteners (16). Fasteners (16) in this embodiment are metal nails, but staples or any other appropriate fasteners could be used. Step unit (11) is prefabricated. In the prefabricated condition, the rear edge of tread (12) and the bottom edge of riser (13) are defined by the dashed lines. Angle (17) is determined by the angle of stringer (27) to the floor after stringer (27) has been installed. The rear edge of tread (12) and the bottom edge of riser (13) are then cut at appropriate angles and length such that, when step unit (11) is installed on stringer (27), tread (12) is substantially level and riser (13) is substantially plumb. In the present embodiment, tread (12) and riser (13) are constructed of plywood and/or particle board, but any other strong and appropriate material could be used.

Figure 3:
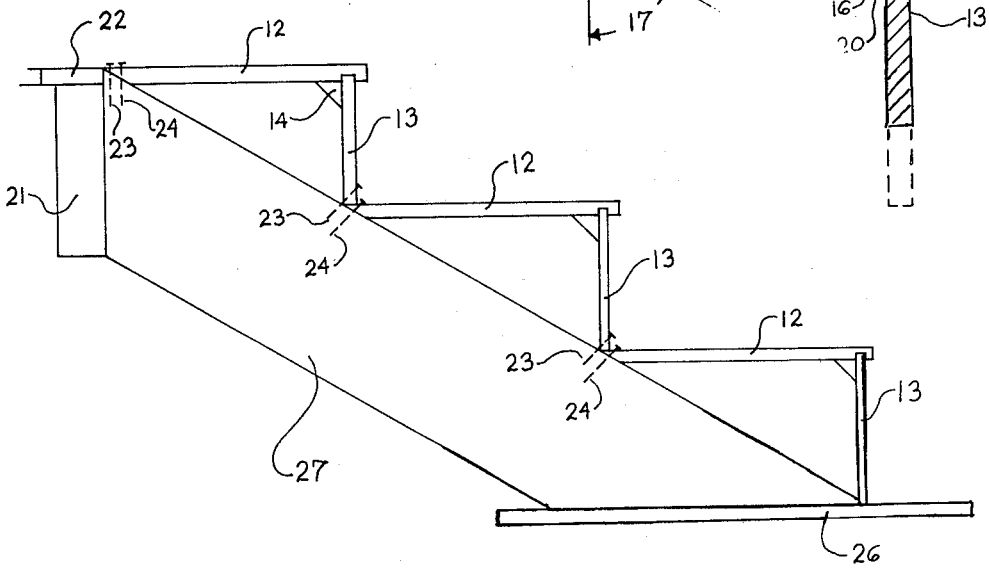
FIG. 3 is a side view of a stairway showing the mode of attaching the tread-riser modules to the unnotched stringer.

FIG. 3 shows an abbreviated stairway (10) with three step units (11) illustrating the mode of attaching step units (11) to stringer (27), and showing other construction details of the stairway (10). Structural member (21) is a horizontal support beam which supports upper floor (22) and against which stairway (10) rests and is attached. Stringers (27) extend between structural member (21) and the floor (26). In the assembly of stairway (10), stringers (27) are first secured in place between structural support member (21) and floor (26). Once stringers (27) are installed and angle (17) and the step run and step rise have been determined, tread (12) and riser (13) of step units (11) are cut accordingly. The lower step is installed first with fasteners (24). Once the lower step is installed, the builder installs the next higher step by setting its riser (13) atop the tread (12) of the lower step where tread (12) of the lower step meets stringer (27). The second step is then secured to stringer (27) through the use of fasteners (23) at riser (13) and fasteners (24) at tread (12). Tread (12) of the upper step is secured to stringer (27) through the use of multiple fasteners (23) and (24). While the stairway construction shown in FIG. 3 indicates that angle (17) on tread (12) has been cut, it shows a square edge at the bottom of riser (13) on each of the step units (11). The bottom edge of riser (13) is cut to match the step rise required.

Because of the use of structural support block (14) and the way in which riser (13) and tread (12) are fastened together, step unit (11) gains considerable structural strength. Further strength in the stairway (10) itself is gained as a result of the matching of angle (17) to the angle of stringer (27), which results in distribution of weight over the entire beveled area and consequently reduces stress. Depending upon the width of stairway (10), two or more stringers (27) may be used.

While the foregoing has been a description of the preferred embodiment of the present invention, it is applicant's intent that, because obvious modifications will occur to those skilled in the art of constructing stairways, the scope of this invention shall not be limited by the prior descriptions, but only by the claims which follow.

I claim:

1. A stairway construction system for use between upper and lower levels of a structure, comprising:

a. two or more notchless stringers for use between upper and lower levels of a structure, each having an upper surface, and b. a modular stair step unit mountable on said upper surface of said notchless stringers and consisting substantially of:

i. a substantially rectangular tread member having a front edge, a rear edge, a bottom surface and a groove in said bottom surface substantially parallel to and near said front surface;

ii. a substantially rectangular riser member having a top edge fitted into said groove in said tread member and rigidly attached thereto, and further having a bottom edge and a back surface, and iii. structural support means rigidly attached to said bottom surface of said tread member and said back surface of said riser member;

said rear edge of said substantially rectangular tread member and said bottom edge of said substantially rectangular riser member being trimmable in the field so that said modular stair step unit is easily modified to accommodate construction of stairways with different run and rise requirements.

2. The invention of claim 1, including securing means for attaching said modular stair step unit to said upper surface of said notchless stringers.

3. The invention of claim 2, wherein the corner of said tread member defined by said rear edge of said tread member and said bottom surface of said tread member is removed, forming a beveled edge at an angle required to set said tread member substantially level when said beveled edge is attached to said upper surface of said notchless stringers and when said notchless stringers are installed between said upper and lower levels of said structure.

4. The invention of claim 2, wherein two or more of said modular stair step units are attached to said upper surface of said notchless stringers, with the lowest of said stair step units installed first and with each successively higher stair step unit installed with its said bottom edge of its said riser member sitting on and contacting said top surface of said tread member of said stair step unit immediately below it.

5. The invention of claim 1, wherein the corner of said tread member defined by said rear edge of said tread member and said bottom surface of said tread member is removed, forming a beveled edge at an angle required to set said tread member substantially level when said beveled edge is attached to said upper surface of said notchless stringers and when said notchless stringers are installed between said upper and lower levels of said structure.

6. The invention of claim 1, wherein two or more of said modular stair step units are attached to said upper surface of said notchless stringers, with the lowest of said stair step units installed first and with each successively higher stair step unit installed with its said bottom edge of its said riser member sitting on and contacting said top surface of said tread member of said stair step unit immediately below it.

7. A method of constructing a stairway, comprising:

a. constructing modular stair step units, consisting substantially of:

i. a substantially rectangular tread member having a front edge, a rear edge, a bottom surface and a groove in said bottom surface substantially parallel to and near said front surface;

ii. a substantially rectangular riser member having a top edge fitted into said groove in said tread member and rigidly attached thereto, and further having a bottom edge and a back surface, and iii. structural support means rigidly attached to said bottom surface of said tread member and said back surface of said riser member; said rear edge of said substantially rectangular tread member and said bottom edge of said substantially rectangular riser member geing trimmable in the field so that said modular stair step unit is easily modified to accommodate construction of stairways with different run and rise requirements;

b. constructing at least two notchless stringers, each having two ends and an upper surface;

c. securing said notchless stringers in place between upper and lower floor levels;

d. trimming said bottom edge of said riser members to a desired rise dimension;

e. trimming said rear edge of said tread members so that said tread members are substantially level when said modular stair step units are positioned on said notchless stringers, and f. securing said modular stair step units to said top surface of said notchless stringers to form said stairway.

* * * * *